United States Patent [19]

Kobayashi

[11] Patent Number: 4,760,361

[45] Date of Patent: Jul. 26, 1988

[54] DOUBLE-MODE FILTER

[75] Inventor: Yoshio Kobayashi, Oomiya, Japan

[73] Assignee: Murata Manufacturing Co., Ltd., Japan

[21] Appl. No.: 21,186

[22] Filed: Mar. 3, 1987

[30] Foreign Application Priority Data

Mar. 4, 1986 [JP] Japan ..... 61-47862

[51] Int. Cl.[4] ..... H01P 1/219; H01P 7/10

[52] U.S. Cl. ..... 333/209; 333/210; 333/212

[58] Field of Search ..... 333/202, 208–212, 333/219, 227–235

[56] References Cited

U.S. PATENT DOCUMENTS 4,489,293 12/1984 Fiedziuszko ..... 333/202
4,540,955 9/1985 Fiedziuszko ..... 333/212 X
4,642,591 2/1987 Kobayashi ..... 333/210 X
4,652,843 3/1987 Tang et al. ..... 333/212

FOREIGN PATENT DOCUMENTS

Al-0064799 11/1982 European Pat. Off. .
Al-0114140 7/1984 European Pat. Off. .
57-194603 11/1982 Japan .
1385508 2/1975 United Kingdom .

*Primary Examiner*—Marvin L. Nussbaum
*Attorney, Agent, or Firm*—Ostrolenk, Faber, Gerb & Soffen

[57] ABSTRACT

A double-mode filter having double-mode resonance in each resonator, with at least two dielectric resonators being accommodated within a cut-off waveguide having a given axial length. This double-mode filter is easier to design, easier to manufacture through simplified construction, and also has smaller insertion loss. No metallic bulkhead having a coupling slot is required between each pair of stages, so that lower loss is achieved or the coupling coefficient may be analytically calculated, thus realizing high-precision design.

9 Claims, 5 Drawing Sheets

DOUBLE-MODE FILTER

BACKGROUND OF THE INVENTION

The present invention relates to a filter wherein double-mode resonance is caused in the resonator with a dielectric resonator being accommodated within a cut-off waveguide having a given axial length.

An elliptic function-type filter is known, wherein a plurality of cavity resonators are disposed in the longitudinal columns, coupling slots are provided in the faces of the cavity resonators for crossing the propagation-direction axis of the electromagnetic-field energy, the double-mode resonance is caused with a dielectric resonator element being accommodated within each cavity resonator, and each stage is coupled through the coupling slot. See Japanese Patent Application (unexamined) Publication Tokkai-sho No. 57-194603 which is equivalent to U.S. Pat. 4,489,293. However, this known construction uses a compound type of resonator composed of a cavity resonator and a dielectric resonator element disposed within the cavity resonator, which has the difficulty in production that a bulkhead having the coupling slot has to be provided as the boundary face between the adjacent cavity resonators for the coupling operation among each resonators. Also, the conductor loss is caused because of the existence of the coupling slot, thus resulting in more insertion loss.

SUMMARY OF THE INVENTION

Accordingly, an object of the present invention is to provide a double-mode filter which is free from the disadvantages of such conventional construction as described hereinabove and is easier to design, easier to manufacture through the simplified construction, and also has smaller insertion loss.

In accomplishing these and other objects, according to one preferred embodiment of the present invention, there is provided a double-mode filter wherein a cut-off waveguide having a given axial length and at least first aand second dielectric resonators are provided dielectric resonators are disposed mutually in a given interval within the cut-off waveguide. Means are provided for exciting the double-mode resonances respectively along the first axis within the section and the second axis crossing the first axis in each of the dielectric resonators, for adjusting the resonance frequency of the first resonance mode and for adjusting the resonance frequency of the second resonance mode, and for controlling the coupling between the first resonance mode and the second resonance mode are provided. An external circuit is coupled to either one among the double-mode resonances of a dielectric resonator by an input coupling means. At least a pair of couplings by an evanescent electromagnetic field are provided among the two resonance modes of the first dielectric resonator and the two resonance modes of the second dielectric resonator. An external circuit is adapted to be coupled to either one among the double-mode resonances of a dielectric resonator by the output coupling means.

BRIEF DESCRIPTION OF THE DRAWINGS

These and other objects are features of the present invention will become apparent from the following description of preferred embodiments thereof with reference to the accompanying drawings, in which.

DETAILED DESCRIPTION OF EMBODIMENTS OF THE INVENTION

Figure 1:
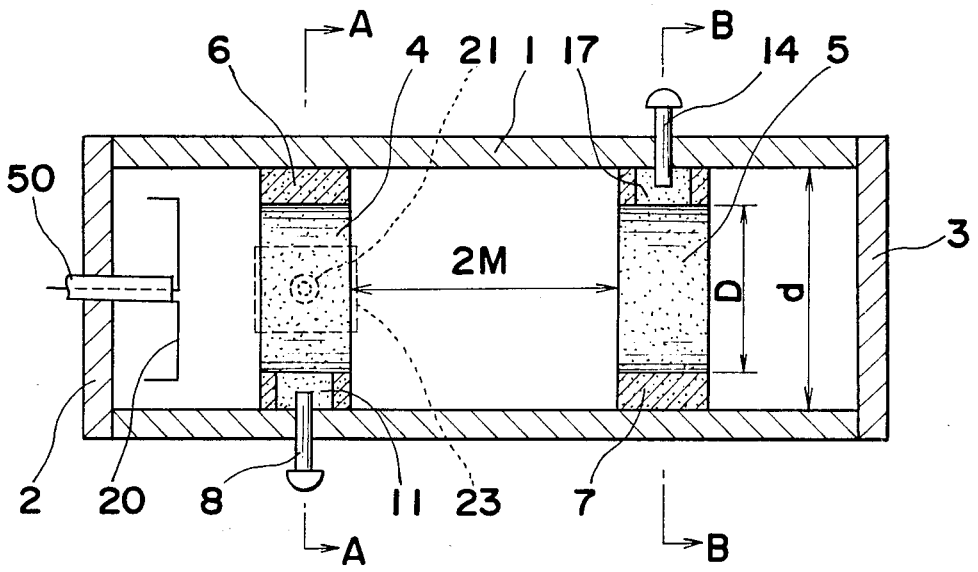
FIG. 1 is a longitudinal sectional view of one embodiment of the present invention.

Before the description of the present invention proceeds, it is to be noted that like parts are designated by like reference numerals throughout the accompanying drawings.

According to the present invention, no metallic bulkhead having a coupling slot between each stage is provided, so that lower loss is achieved or the coupling coefficient may be analytically calculated (see MW 85-99, November 1985, for example Kobayashi, Nakayama: Electronic Communication Society Report), thus realizing high-precision design.

Figure 2:
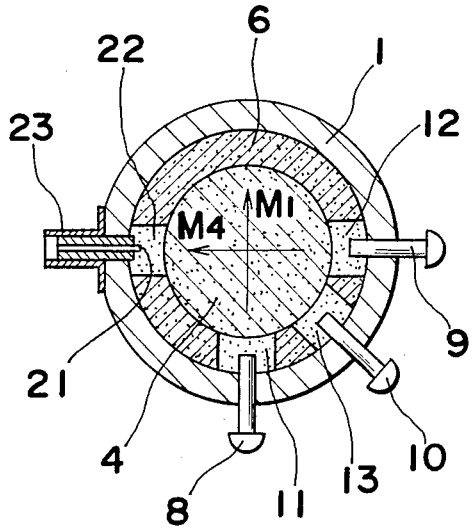
FIG. 2 is a cross-sectional view taken along a line A—A of FIG. 1.
Figure 3:
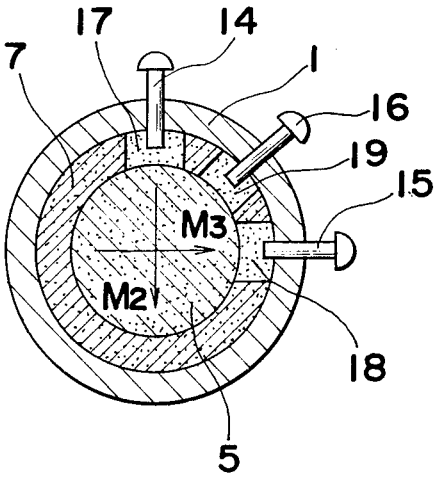
FIG. 3 is a cross-sectional view taken along a line B—B of FIG. 1.

Referring now to the drawings, there is shown in FIGS. 1 through 3, a double-mode filter according to one preferred embodiment of the present invention, which includes a $TE_{11}$ closed, conductive conduit waveguide 1 of a given axial length. The filter comprises a cylindrical conductor with covers 2, 3 being provided on both of its ends to make up the waveguide 1. Known ceramic-dielectric cylindrical resonators 4, 5 are fixedly disposed in coaxial relation with the waveguide 1 and with given intervals between the resonators 4, 5 and the covers 2, 3. More concretely, these resonators 4, 5 are fixedly disposed within the waveguide 1 by the ring-shaped support spacers 6, 7 composed of, for example, polystyrene or PTFE of low dielectric constant.

The first resonance frequency fine-adjustment screw 8 is screwed into the waveguide 1 in the upward direction from below in FIG. 2 along a line M1 extending and passing through the center of the resonator 4. The fourth resonance frequency fine-adjustment screw 9 is screwed in the leftward direction from the right in FIG. 2 into the waveguide 1 along a line M4 located in a position rotated in the peripheral direction of the resonator 4 by 90° with respect to the line M1.

The first screw 10 for adjusting the coupling degree is screwed into the waveguide 1 in a location offset from the screw 8 and the screw 9 by 45° and within the plane including the screws 8, 9. The cut-off portions or through-holes 11, 12, 13 which do not prevent the screws 8, 9, 10 from being moved are formed when necessary, i.e., when the spacers 6, 7 are annular as shown, in the locations of the spacer 6 into which these screws 8, 9, 10 are thrust.

Similarly, the second resonance-frequency fine-adjustment screw 14 is screwed into the waveguide 1 in the downward direction from above in FIG. 3 along a line M2 extending and passing through the center of the resonator 5. The third resonance-frequency fine-adjustment screw 15 is screwed in the leftward direction from the right in FIG. 3 into the waveguide 1 along a line located in a position rotated in the peripheral direction of the resonator 5 by 90° with respect to the line M2. The screw 15 is screwed along the line M3, which represents an electric line of force as discussed further below, but in the opposite direction. The second screw 16 for adjusting the coupling degree is screwed into the waveguide 1 in a location offset from the screw 14 and the screw 15 by 45° and screw 14 within the plane including the 15. The cut-off portions 17, 18, 19 which do not prevent the screws 14, 15, 16 from being moved are formed when necessary in the locations of the spacer 7 into which these screws 14, 15, 16 are thrust. The screws 8 through 10, 14 through 16 are composed of metallic, dielectric or magnetic material.

An electric dipole element 20 (referred to as the dipole hereinafter) is inserted into the waveguide 1 from the cover 2 in the axial direction of the waveguide 1 and is fed by the coaxial cable 50 with the longitudinal direction of the dipole 20 being parallel to the axial line M1 through the screw 8, both the tip ends being bent in the direction away from the resonator 4. The bending process is provided to adjust the electric length of the dipole. A probe 21 is projected into the waveguide 1 in the central direction of the resonator 4 from the peripheral direction of the waveguide 1 and is disposed on the line M4 passing through the screw 9. The cut-off portion 22 is formed when necessary in the corresponding portion of the spacer 6 into which the probe 21 is thrust. A coaxial connector 23 is connected with the probe 21.

Figure 4:
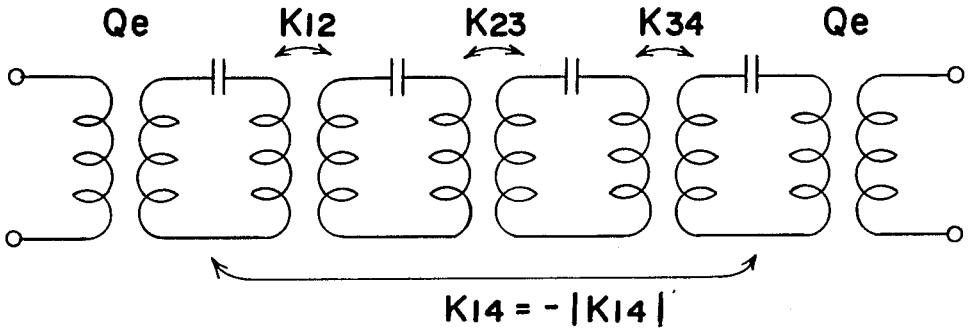
FIG. 4 is an equivalent-circuit diagram of the embodiment.

Assume that the probe 21 is used for the output coupling application with the dipole 20 being used for the input coupling application; this operation will now be described. The first $EH_{11}\delta$ mode, with the direction shown by the arrow M1 being the electric field direction within the cross section of waveguide 1, is excited by the resonator 4 in response to the electric field produced by the dipole 20, further in response to the signals transmitted by the coaxial cable 50. The second $EH_{11}\delta$ mode, by the direction shown with the arrow M2 being the electric field direction within the cross section of waveguide 1, is excited with the resonator 5 in response to the evanescent electromagnetic field produced in the cut-off region, i.e., the region between the resonators 4, 5, by the first $EH_{11}\delta$ mode. The third $EH_{11}\delta$ mode, by the direction shown with the arrow M3 being in the electric field direction within the cross section of waveguide 1, exists in the resonator 5 in a position rotated in the peripheral direction by 90° from the electric field of the second $EH_{11}\delta$ mode. The coupling degree between the second $EH_{11}\delta$ mode and the third $EH_{11}\delta$ mode, that is, between the double modes, is determined by the insertion length of the screw 16. And the fourth $EH_{11}\delta$ mode, with the direction shown by arrow M4 being the electric field direction within the cross section of waveguide 1, is excited in the resonator 4 by the evanescent electromagnetic field produced in the cut-off region by the third $EH_{11}\delta$ mode. The fourth $EH_{11}\delta$ mode is coupled with the probe 21 so that the output is drawn through the coaxial connector 23. The coupling degree between the first $EH_{11}\delta$ mode and the fourth $EH_{11}\delta$ mode, that is, between the double modes, is determined by the insertion length of the screw 10. In this embodiment the adjustment is made so that the proper combination may be provided between these two modes to provide the attenuation pole. The present embodiment provides a four-stage elliptic function type filter whose equivalent circuit is shown in FIG. 4. Kij in the drawing shows the coupling coefficient between the ith resonance and the jth resonance. In order to make the coupling coefficient K14 a negative value, the screws 10, 16 are desired to be disposed away from each other by 90° in the peripheral direction when viewed from the axial direction of the waveguide 1.

As described hereinabove, the filter of this embodiment has one mode, of the double modes of one dielectric resonator, excited by the input coupling means. The coupling between the dielectric resonators is provided by the evanescent electromagnetic field. The other mode of said one dielectric resonator is coupled with the output coupling means. And both modes which are normal and are not coupled theoretically are coupled by the coupling control means to provide an elliptic function type filter, that is, a filter having an attenuation pole.

Figure 6:
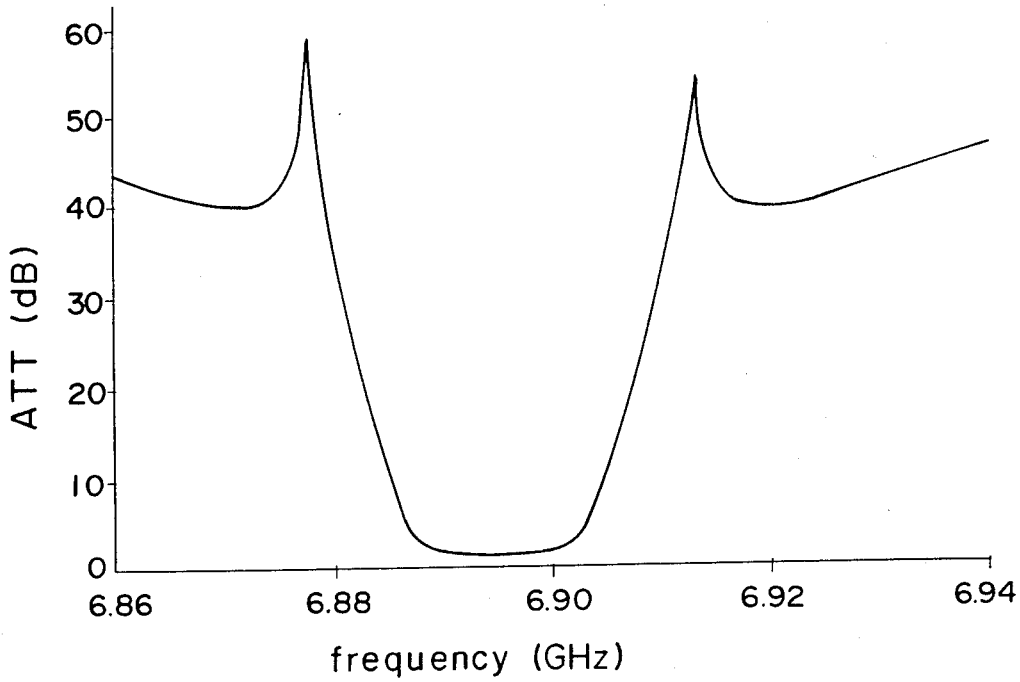
FIG. 6 is a attenuation characteristic graph in the embodiment.
Figure 5:
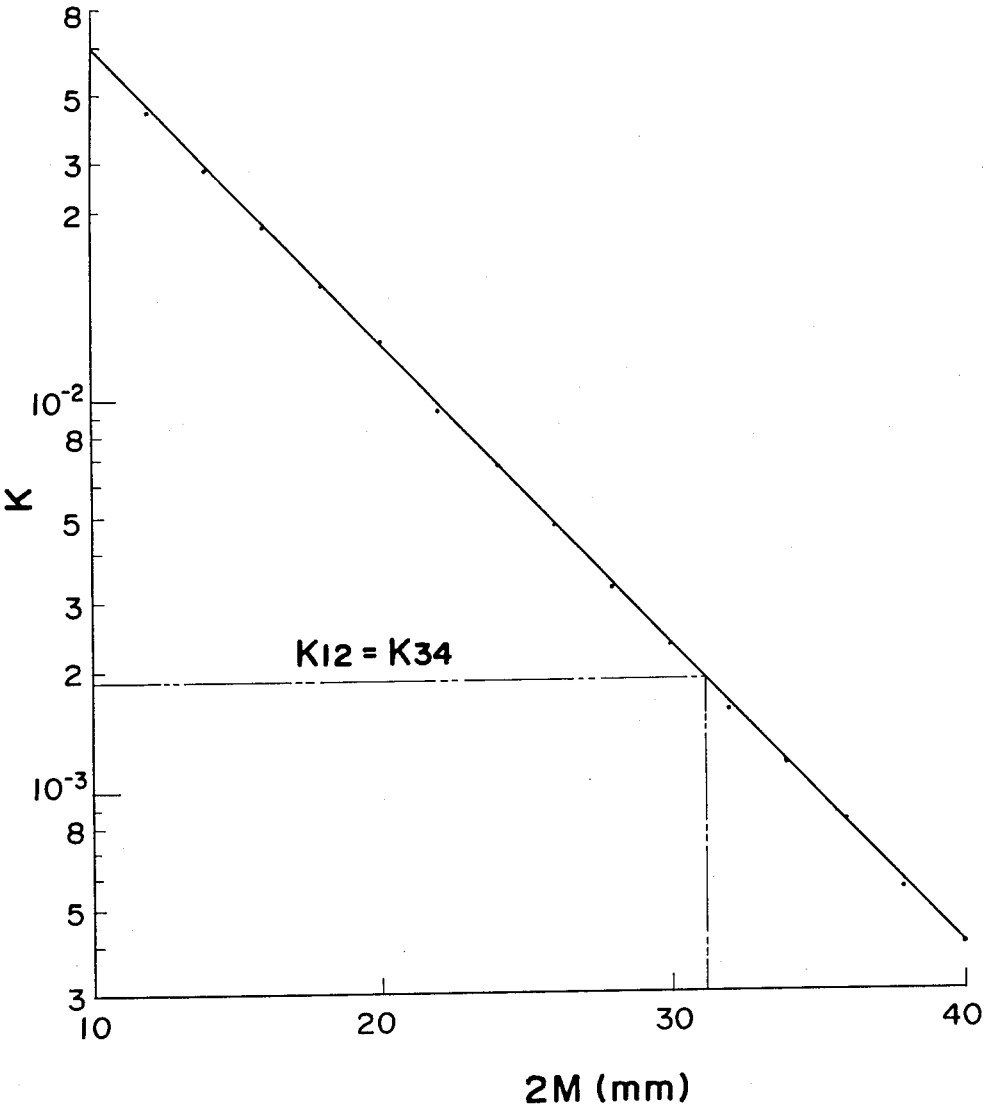
FIG. 5 is a relation graph between an interresonance distance and a coupling coefficient.

A manufacturing example will be described hereinafter. In the manufacturing example, $K_{12}=K_{34}=1.91\times10^{-3}$, $K_{23}=1.48\times10^{-3}$, $K_{14}=-0.20\times10^{-3}$, Qe=375 were used as the design values for provision of the specification of central frequency fo=6.895 GHz, 3 dB ratio-band width $\Delta f/fo=0.25\%$, stopping-band minimum damping amount=40 dB, ripples within the band=0.01 dB. The resonance frequency of the resonator and $K_{12}=K_{34}$ are calculated with high precision by the use of the mode expansion method. The calculation value of the $K_{12}=K_{34}$ and the measured value are shown in FIG. 5. In the drawing, the solid line is the calculated value, the black spots are the measured values. The coupling coefficient $K_{12}=K_{34}$ between the resonators 4, 5 is determined by the distance 2M between the resonators 4, 5 like this. The ceramics have the ratio dielectric constant $\epsilon r=30$, the diameter D=11 mm, and shaft length L=3 mm, in the resonators 4, 5. The inner diameter of the waveguide 1 is 16 mm, and the ratio dielectric constant, of the spacers 6, 7 is 1.037 ratio dielectric constant except for the portion where the resonators 4, 5 and the spacers 6, 7 exist is 1,0, that is, the dielectric constant of air. Also, the necessary values of the K23, K14 and Qe are determined by the experiments. The attenuation characteristics of the manufacturing example provided in this manner are shown in FIG. 6.

Figure 7:
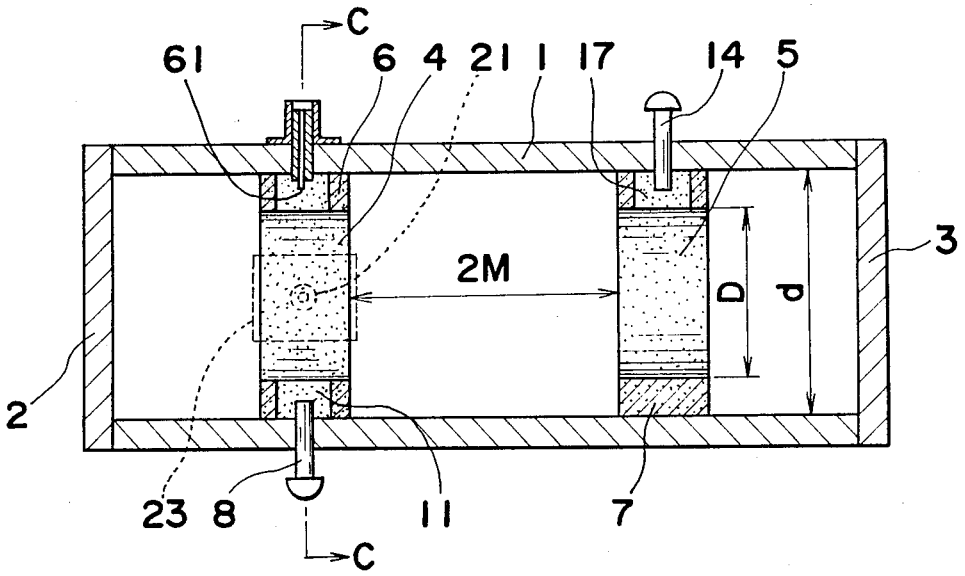
FIG. 7 is a longitudinal sectional view of the modified embodiment.
Figure 8:
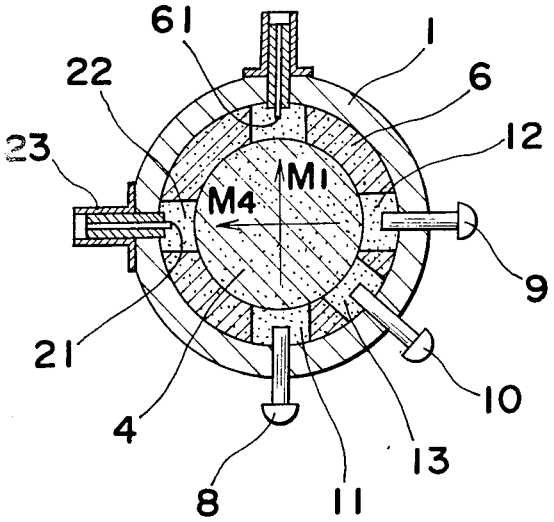
FIG. 8 is a cross-sectional view taken along a line C—C of FIG. 7.

Now a modified example will be described. As shown in FIG. 7, and FIG. 8, a probe 61, which is similar to the probe 21, may be used instead of the dipole. The probe 61 is projected into the waveguide 1 along line M1, i.e., in the central direction of the resonator 4 from a position normal in the peripheral direction with respect to the probe 21.

The input coupling means and the output coupling means may be provided in the various constructions in this manner. That is, the necessary mode is required to be coupled with the mode to be excited or necessary. The filter becomes the elliptic function type filter if the double modes of the resonator 4 are coupled through the adjustment of the screw 10. If the double modes are not coupled, a filter which does not have the attenuation pole is provided.

The control of the coupling between the double modes may alternatively be performed by cutting-off one portion of the peripheral face of the resonator, instead of the coupling-degree adjusting screw, as disclosed in FIG. 14 of, for example, Kobayashi, Kubo: Electronic Communication Society Report MW 85-86 (Oct. 1985).

Also, the means for adjusting the resonance frequency of each resonance mode may include not only such screws as shown, but also any known means for changing or adjusting the elements playing roles in the determination of the resonance frequency, for example, the cutting-off operation. The resonators 4, 5 or the waveguide 1 may be not only circular in the cross-sectional shape with respect to the axis direction, but also square or rectangular. That is, the cross-sectional configuration of the resonators may be either square or rectangular, regardless of whether the waveguide has a configuration that is square, rectangular or circular or the like.

Furthermore, it may be required for elliptic function type filter characteristics to be provided by the coupling of, for example, the input coupling means with one mode of the resonator 4, and the coupling of the output coupling means with one mode of the resonator 5. In this case, the first $EH_{11}\delta$ mode, with the direction shown by the arrow mark $M_1$ being the electric field direction within the cross section of waveguide 1, is coupled with the fourth $EH_{11}\delta$ mode, with the direction shown by the arrow mark $M_4$ being the electric field direction within the cross section of waveguide 1. Further the fourth $EH_{11}\delta$ mode is coupled with the third $EH_{11}\delta$ mode, with the direction shown by the arrow mark $M_3$ being the electric field direction within the cross section of waveguide 1, and the third $EH_{11}\delta$ mode is coupled with the second $EH_{11}\delta$ mode, with the direction shown by the arrow mark $M_2$ being the electric field direction within the cross section of waveguide 1. Finally the first $EH_{11}\delta$ mode is required to be coupled with the second $EH_{11}\delta$ mode for the provision of the elliptic function type characteristics.

Figure 9:
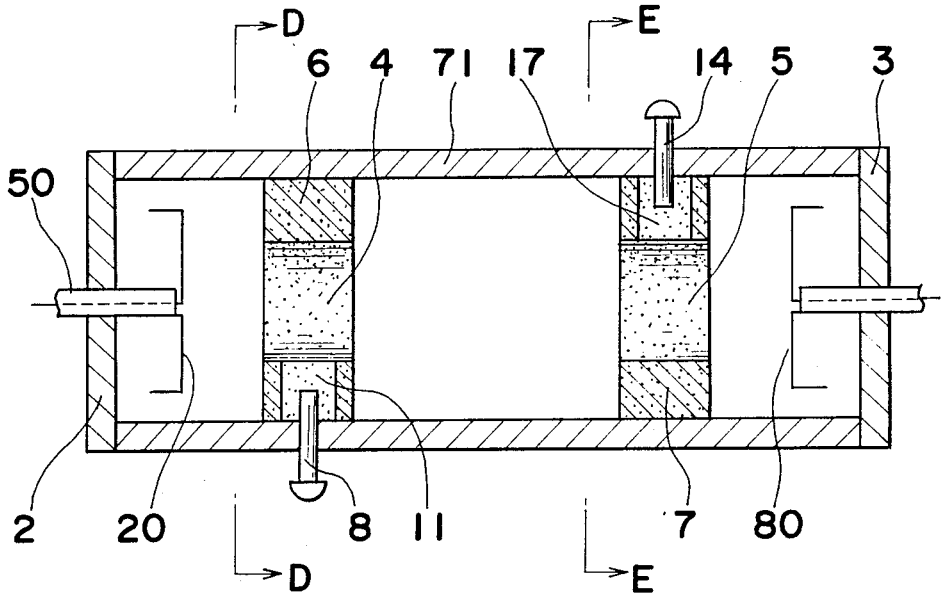
FIG. 9 is a longitudinal sectional view in the other embodiment.
Figure 10:
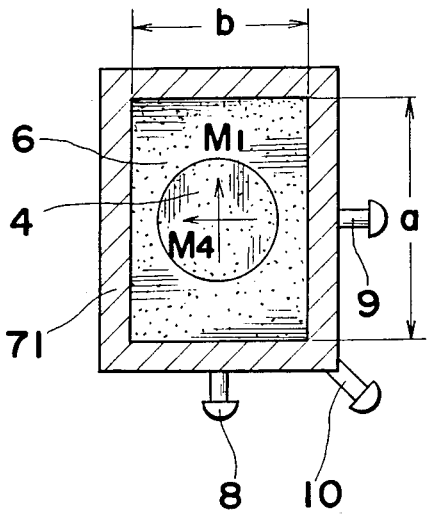
FIG. 10 is a cross-sectional view taken along a line D—D of FIG. 9.
Figure 11:
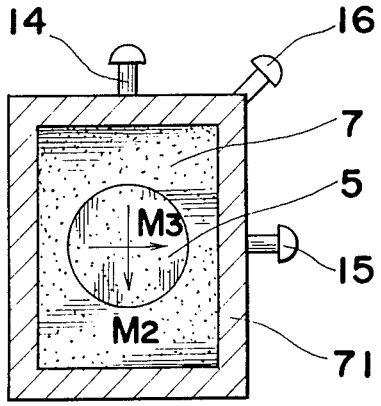
FIG. 11 is a cross-sectional view taken along a line E—E of FIG. 9.

In a further embodiment, the mode between the first $EH_{11}\delta$ mode and the second $EH_{11}\delta$ mode is adapted to become weaker than the coupling between the fourth $EH_{11}\delta$ mode and the third $EH_{11}\delta$ mode as shown in FIG. 9 through FIG. 11. In the illustrated example, the output coupling means is coupled with the second $EH_{11}\delta$ mode of the resonator 5 by the use of the dipole 80, similar to the dipole 20.

It is to be noted that the number of the resonators is not restricted to two by the above-described embodiments. Not only the $EH_{11}\delta$ mode, but also, for example $HE_{11}\delta$ mode may be the employed mode.

Although the present invention has been fully described by way of example with reference to the accompanying drawings, it is to be noted here that the examples are illustrative, not limiting, and that various changes and modifications will be apparent to those skilled in the art. Therefore, unless otherwise such changes and modifications depart from the scope of the present invention, they should be constructed as being included therein.

What is claimed is:

1. A double-mode filter comprising a cut-off waveguide having an axis;

at least first and second dielectric resonators disposed in said waveguide along said axis, and separated by a predetermined interval; said first resonator having first and fourth mutually perpendicular resonance modes; said second resonator having second and third mutually perpendicular resonance modes;

means for controllably coupling the first and fourth resonance modes, and for controllably coupling the second and third resonance modes;

said first and second resonance modes being coupled by an electromagnetic field in said interval between said resonators;

said third and fourth resonance modes being coupled by an electromagnetic field in said interval between said resonators;

means for adjusting the frequency of said first, second, third, and fourth resonance modes;

input means coupled to said one mode of said first resonator for receiving an input signal and, in response thereto, exciting said first, second, third, and fourth resonance modes, output means coupled to another of said resonance modes of said filter for being excited thereby and extracting an output signal from said filter.

2. A filter as in claim 1, wherein said input means comprises a dipole coupled to said first resonance mode.

3. A filter as in claim 2, wherein said output means comprises a probe coupled to said fourth resonance mode.

4. A filter as in claim 2, wherein said output means comprises a dipole coupled to said second resonance mode.

5. A filter as in claim 1, wherein said input means comprises a probe coupled to said first resonance mode.

6. A filter as in claim 5, wherein said output means comprises a probe coupled to said fourth resonance mode.

7. A filter as in claim 1, wherein said resonance modes are $EH_{11}$-delta modes.

8. A filter as in claim 1, wherein said resonance modes are $HE_{11}$-delta modes.

9. A filter as in claim 1, wherein said waveguide is a $TE_{11}$ cut-off waveguide.

* * * * *